US008456299B2

(12) United States Patent
Foisy et al.

(10) Patent No.: US 8,456,299 B2
(45) Date of Patent: Jun. 4, 2013

(54) AUTOMATED AUDIO MESSAGING IN TWO-WAY VOICE ALARM SYSTEMS

(75) Inventors: Stephane Foisy, Udora (CA); Oscar Noyola, Toronto (CA); Derek Smith, Maple (CA); Reyzaldi Sacuevo, Whitby (CA)

(73) Assignee: Tyco Safety Products Canada Ltd., Concord, Ontario (CA)

( * ) Notice: Subject to any disclaimer, the term of this patent is extended or adjusted under 35 U.S.C. 154(b) by 321 days.

(21) Appl. No.: 12/957,720

(22) Filed: Dec. 1, 2010

(65) Prior Publication Data

US 2012/0139718 A1 Jun. 7, 2012

(51) Int. Cl.
*G08B 1/08* (2006.01)

(52) U.S. Cl.
USPC ..... 340/539.16; 340/539.14; 340/539.18

(58) Field of Classification Search
None
See application file for complete search history.

(56) References Cited

U.S. PATENT DOCUMENTS

2003/0014324 A1* 1/2003 Donovan et al. ..... 705/26
2007/0061145 A1* 3/2007 Edgington et al. ..... 704/262
2007/0075848 A1* 4/2007 Pitt ..... 340/426.2
2007/0109114 A1* 5/2007 Farley et al. ..... 340/506
2008/0129517 A1* 6/2008 Crosby et al. ..... 340/573.1
2008/0191857 A1* 8/2008 Mojaver ..... 340/500
2008/0224862 A1* 9/2008 Cirker ..... 340/541
2008/0233932 A1* 9/2008 Sapp ..... 455/415
2009/0002179 A1* 1/2009 Jennewine ..... 340/573.1
2010/0007488 A1* 1/2010 Sharma et al. ..... 340/539.17

FOREIGN PATENT DOCUMENTS

WO WO 2008/116047 A1 9/2008

OTHER PUBLICATIONS

International Searching Authority, International Search Report and Written Opinion dated Jan. 6, 2012 for International Application No. PCT/CA2011/001124, International Filing Date Oct. 7, 2011 (8 pages).

* cited by examiner

*Primary Examiner* — Travis Hunnings
(74) *Attorney, Agent, or Firm* — Smart & Biggar

(57) ABSTRACT

An alarm monitoring station is capable of establishing a two way communications channel over a network to connect the monitoring station and alarm panels at monitored premises, for real time voice communication between the panels and the monitoring station. The monitoring station is further operable to provide pre-programmed voice messages to the alarm panels based on the sensed alarm condition over the two way communications channel. In this way, occupants at the premises may be notified of the sensed condition before speaking with an operator at the monitoring station.

18 Claims, 5 Drawing Sheets

AUTOMATED AUDIO MESSAGING IN TWO-WAY VOICE ALARM SYSTEMS

FIELD OF THE INVENTION

The present invention relates generally to security systems, and more particularly to methods and devices for providing audio messages at a monitored premises using two-way voice alarm systems.

BACKGROUND OF THE INVENTION

It is common for businesses and homeowners to have a security system for detecting alarm conditions at their premises and reporting these to a monitoring station. One of the primary functions of the monitoring station is to notify a human operator when one or more alarm conditions have been sensed by detectors installed at a monitored premises.

Detectors may vary from relatively simple hard-wired detectors, such as door or window contacts to more sophisticated battery operated ones, such as motion and glass break detectors, to detect a variety of alarm conditions. Detectors may, for example, detect entries and exits to the premises, fire, glass breakage, noxious gases, flood, or the like.

The detectors may all report to an alarm control panel at the premises. The control panel is typically installed in a safe location and is connected to a power supply. The control panel is further in communication with the individual detectors to communicate with or receive signals from individual detectors. The communication between the alarm control panel and the detectors can be one or two way, and may be wired or wireless.

Communication between the premises and the monitoring station is typically effected using any of a number of communications networks, including the public switched telephone network (PSTN); a cellular telephone or data network; a packet switched network (e.g. the Internet), or the like.

Recently, equipping the premises with audio detectors (e.g. microphones) and audio output transducers (e.g. speakers) and providing two-way communication between the premises and the monitoring station has become commonplace. Microphones provide audio signals, representing audio sensed at the microphone to the monitoring station, thereby allowing the monitoring station to monitor audio at the premises in case of an alarm condition. The speakers, in turn, allow an operator at the monitoring station to speak with occupants at the premises in real-time.

Conveniently, an operator at the monitoring station may listen and react to events at a monitored premise, as they occur. For example, the operator at the monitoring station may speak to an occupant or intruder upon being notified of an alarm condition.

Typically, the channel(s) that are used to carry the two-way communication remain underutilized.

Accordingly, there remains a need for improved two-way alarm systems and methods used in such systems.

SUMMARY OF THE INVENTION

Exemplary of embodiments of the present invention, an alarm monitoring station is capable of establishing a two way communications channel over a network to connect the monitoring station and alarm panels at monitored premises, for real time voice communication between the panels and the monitoring station. The monitoring station is further operable to provide a pre-programmed voice messages to the alarm panels based on the sensed alarm condition over the two way communications channel. In this way, occupants at the premises may be notified of the sensed condition before speaking with an operator at the monitoring station.

In accordance with a first aspect of the present invention, there is provided a method of operating an alarm monitoring station. The method comprises: a. receiving an alarm message signalling an alarm condition at a premises from an alarm panel; b. establishing a two way communications channel over a network to connect the monitoring station and the alarm panel, for real time voice communication between the panel and monitoring station; c. selecting a pre-programmed voice message based on the sensed alarm condition; and d. providing the pre-programmed voice message to the panel over the two way communications channel.

In accordance with another aspect of the present invention, there is provided an alarm monitoring station comprising at least one processor operable to a. receive an alarm message signalling an alarm condition at a premises from an alarm panel; b. establish a two-way communications channel over a network to connect the monitoring station and the alarm panel, for real time voice communication between the panel and the monitoring station; c. select a pre-programmed voice message based on the sensed alarm condition; and d. provide the pre-programmed voice message to the panel over the two way communications channel.

In accordance with yet another aspect of the present invention, there is provided a method of operating an alarm panel at a premises. The method comprises: a. providing an alarm message signalling an alarm condition at the premises to a monitoring station; b. establishing a two way communications channel over a network to connect the monitoring station and the alarm panel, for real time voice communication between said panel and monitoring station; and c. receiving a pre-programmed voice message over the two way communications channel, the pre-programmed voice message selected at the alarm monitoring station based on the sensed alarm condition.

Other aspects and features of the present invention will become apparent to those of ordinary skill in the art upon review of the following description of specific embodiments of the invention in conjunction with the accompanying figures.

BRIEF DESCRIPTION OF THE DRAWINGS

In the figures which illustrate by way of example only, embodiments of the present invention.

DETAILED DESCRIPTION

Figure 1:
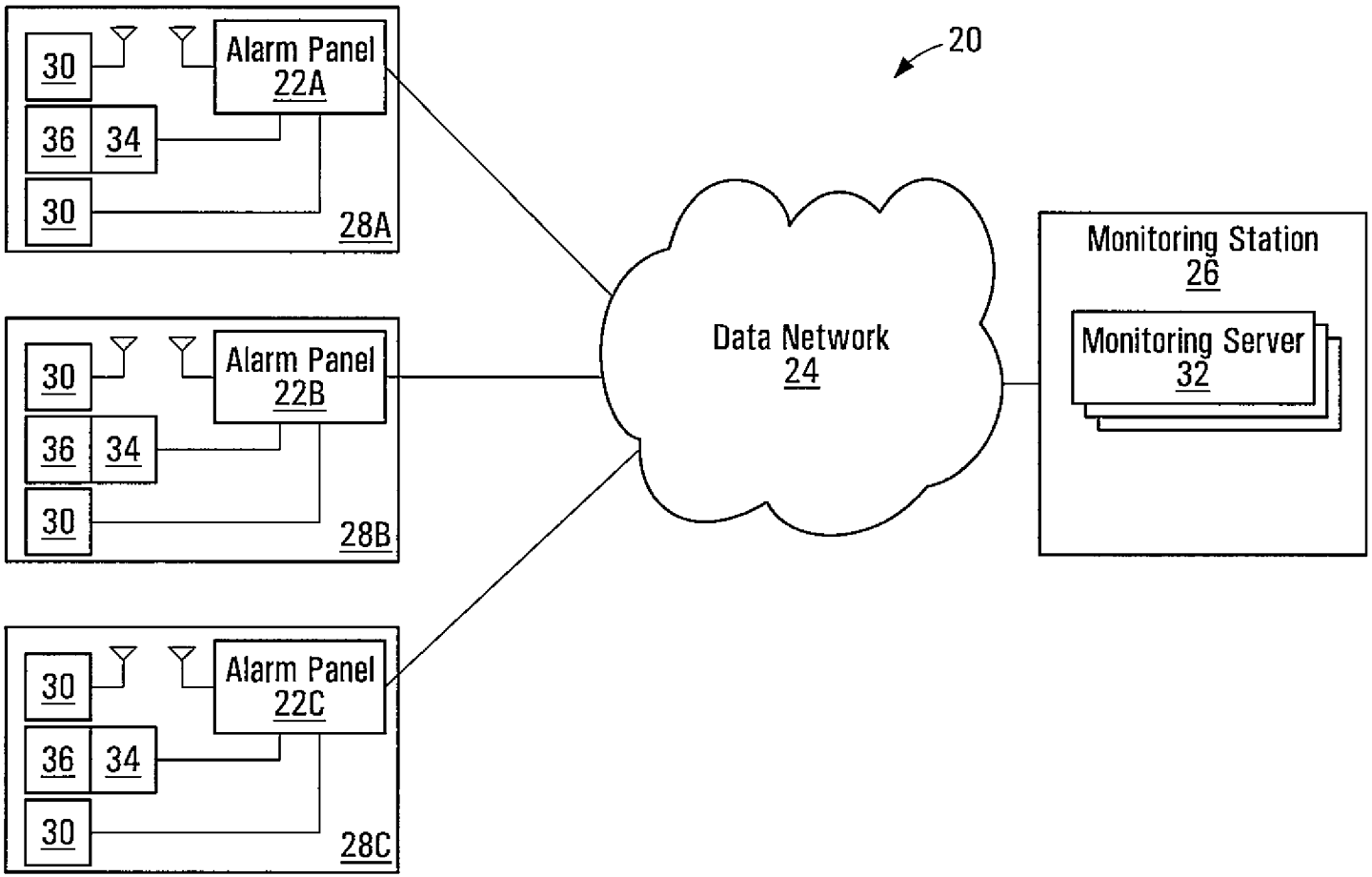
FIG. 1 is a schematic diagram of an alarm system, exemplary of an embodiment of the present invention.

FIG. 1 depicts an exemplary security system infrastructure 20 of security systems including multiple alarm panels 22*a*, 22*b*, 22*c* (individually and collectively panel 22) at customers' premises 28*a*, 28*b*, 28*c* (individually and collectively premises 28), respectively, communicating through a data network 24 such as the Internet, with a central monitoring station 26. As will be appreciated, data network 24 may be any combination of wired and wireless links capable of carrying packet switched traffic, and may span multiple carriers, and a wide geography. In one embodiment, data network 24 may simply be the public Internet. Further access points, such as DSL modems, wireless radios, and the like possibly interconnecting panels 22 with data network 24 are not illustrated.

At residential or business premises 28, each alarm panel 22 may be interconnected with one or more detectors 30. Each of detectors 30 provides information regarding the status of the monitored premises to a local alarm panel 22. Detectors 30 may include, for example, fire/smoke detectors, motion detectors, glass break detectors, noxious gas sensors, flood detectors, contact switches, or the like. Detectors 30 may be hard wired to alarm panel 22 or may communicate with alarm panel 22 wirelessly, in manners known to persons of ordinary skill in the art. Alarm panel 22 may further include other interfaces such as key pads, sirens, and the like, not specifically shown in FIG. 1.

One particular detector 36, forming part of system infrastructure 20, is an audio input transducer that acts as a microphone, and allows audio at premises 28 to be sensed. Electrical signals corresponding to the sensed audio are provided to panel 22. The electrical signals may be analog or digital signals that may be compressed, either proximate detector 36 or at panel 22. In the event the signals are digital, they may be encoded at the detector 36.

Additionally, an alarm system at a premises 28 further includes another audio transducer 34 that acts as a loudspeaker to reproduce audio originating from central monitoring station 26, at panel 22. Electrical signals corresponding to the audio are provided by panel 22. The electrical signals may again be analog or digital signals that may be compressed.

Links between panel 22 and detector 36 and transducer 34 may be wired or wireless.

Figure 2:
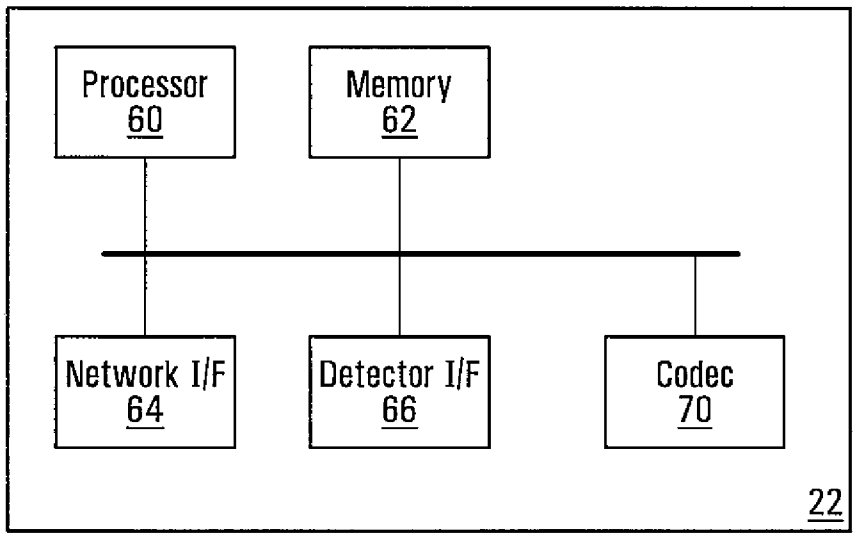
FIG. 2 is a schematic block diagram of a panel in the alarm system of FIG. 1.

As illustrated in FIG. 2, a typical alarm panel 22 includes a processor 60; memory 62 in communication with processor 60, storing program instructions and configuration data for the processor/alarm panel 22; a detector interface 66 for communication with detectors 30/36; and transducer 34; and a network interface 64 for communication with data network 24. Panel 22 further includes an audio/voice coder/decoder (codec) 70 as further described below.

Example alarm panels include Digital Security Controls (DSC) models PC1864 and PC9155, suitable modified to operate as described herein.

As will become apparent, panel 22 is capable of establishing three (3) separate communications paths to a monitoring station 26: one signals alarm conditions to monitoring station 26; one provides audio to monitoring station 26; and one receives audio from monitoring station 26. In the depicted embodiment data network 24 may be used to carry all three paths. However, a skilled person will readily recognize that the three communications paths could be transported over separate networks—such as the PSTN, a wireless network, the internet or the like.

Program instructions stored in memory of alarm panel 22, along with configuration data may control overall operation of panel 22. In particular, one or more data network addresses may be stored in memory of alarm panel 22. These network addresses may include the internet protocol network addresses of central monitoring station 26 by which central monitoring station 26 may be reached. Alarm panel 22 may send data associated with sensed alarm conditions sensed at premises 28 to central monitoring station 26.

Panel 22 may further include a voice codec 70 in communication with detector 36 and audio transducer 34 to encode voice detected at detector, and to decode voice data received from monitoring station 26. Voice codec 70 may, for example, be a voice coder encoder (and decoder), compliant with ITU Recommendation G.711, G.723, G.729, or any other known voice coding algorithm or standard. Voice codec 70 may be a hardware component separate from the processor of panel 22, and is illustrated as such in FIG. 2, or may be formed in software, stored for example in memory 62 for execution by the processor of panel 22.

Figure 3:
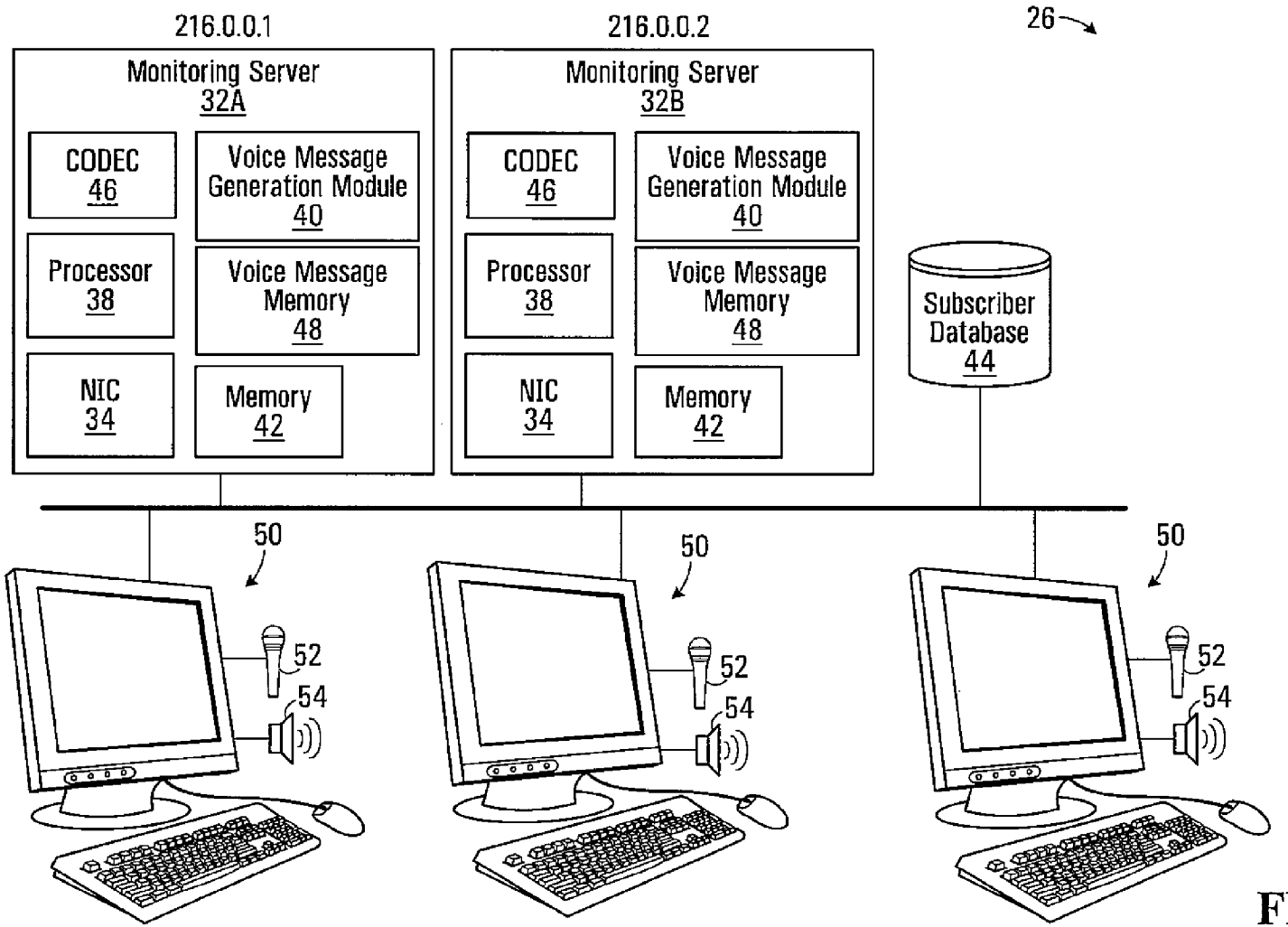
FIG. 3 is a schematic block diagram of a central monitoring station in the alarm system of FIG. 1, exemplary of an embodiment of the present invention.

Central monitoring station 26 is more particularly illustrated in FIG. 3. Monitoring station 26 is depicted as a single monitoring station in FIG. 1; however, it could alternatively be formed of multiple monitoring stations, each at a different physical location, and each in communication with data network 24. In particular, in order to process a high volume of alarm conditions from a large number of subscribers, central monitoring station 26 includes a plurality of monitoring servers 32. Each monitoring server 32 processes alarm messages from panels 22 of subscribers serviced by monitoring station 26. Additionally, a monitoring server 32 may take part in two-way audio communication over network 24, with an interconnected panel 22.

Each monitoring server 32 may include a processor 38, network interface 34 and a processor 30. Monitoring servers 32 may physically take the form of rack mounted cards. Monitoring servers 32 may be in communication with one or more operator terminals 50.

Each monitoring server 32 of central monitoring station 26 may be associated with an IP address and port(s) by which it can be contacted by alarm panels 22 to report alarm events over data network 24, and establish other IP connections. In the depicted embodiment, monitoring server 32*a* is associated with IP address 216.0.0.1; monitoring server 32*b* is associated with IP address 216.0.0.2. These addresses may be static, and thus always identify a particular one of monitoring servers 32 to the computing devices communicating over network 24. Alternatively, dynamic addresses could be used, and associated with static domain names, resolved through a domain name service. As well, in the depicted embodiment, monitoring servers 32 are interconnected on a local area network. A suitable router (not shown) may route data between servers 32 and to a respective server at their associated IP addresses.

Processor 38 of each monitoring server 32 acts as a controller for each monitoring server 32, and is in communication with, and controls overall operation, of each network interface 34. Processor 30 may include, or be in communication with, memory 36 controlling the overall operation of monitoring server 32. Network interface 34 may be a conventional network interface that interfaces with communications network 24 to receive incoming signals, and may for example take the form of an Ethernet network interface card (NIC). Terminal(s) 50 may be computers, or the like, to which received data representative of an alarm event is passed for handling by human operators. Each terminal 50 may include a microphone 52, and an audio transducer/speaker 54 to allow audio to be captured and reproduced at terminal 50.

Each monitoring server 32 further includes a voice message generation module 40, and associated voice message data memory 48. Voice message data memory 48 in combination with voice generation module 40 allows monitoring server 32 to form pre-programmed voice messages under processor control. As will become apparent, the voice messages may be pre-recorded, or formed from pre-recorded words/phrases, or synthesized or formed in another manner understood by those of ordinary skill. Optionally, recorded words and phrases may be concatenated by voice generation module 40, as required to form desired phrases and messages. As such, data in voice message data memory 48 may include pre-recorded words and/or phrases. Alternatively, voice message data memory 48 may contain voice synthesis commands to allow voice generation module to synthesize the desired voice message.

It will be appreciated that voice message generation module 40 may be a separate physical module, or alternatively may be a logical module formed by processor 38 under control of software in memory 42. Codec 46 may be similarly formed.

Monitoring station 26 may further include subscriber database 44 that includes a database under control of a database engine. Database 44 may contain entries corresponding to the various subscribers serviced by monitoring station 26. Database 44 may for example include the names and addresses, phone number, contact number, for each subscriber at premises 28 (FIG. 1). As well, database 44 may include the particulars of each detector 30, the identifier of each panel 24 assigned to a particular subscriber; account information; and the like. Database 44 may further log or archive alarm data received from panels 22, including audio data generated in connection with such alarm events.

Central monitoring station 26 receives and processes incoming messages from panels 22. Extracted data from the messages may, for example, be overhead, or alarm data. The alarm data may be passed to processor 30, which, in turn, may make decisions based upon that data. In particular, processor 30 may be programmed to initiate certain alarm handling procedures based on the received data. Alarm data may, for example, be passed by panels 22 using the SIA Digital Communication Standard—Internet Protocol Event Reporting (as specified in the ANSI/SIA DC-09-2007 Standard, the contents of which are hereby incorporated by reference). As such, alarm data may be packaged into alarm messages identifying the source and type of alarm. Of course, other data communications protocols known to those of ordinary skill may be used for communication between station 26 and panels 22.

For example, alarm data extracted from one or more incoming alarm messages may specify that a particular detector 30 at a particular monitored premise 28 was tripped.

Processor 38 may be programmed to notify a human operator using the alarm data, for further action. Further action may include the human operator consulting, and calling, one of a list of phone numbers associated with that particular monitored premise. For example, the list may include the telephone number of the homeowner, and the operator may call the homeowner to determine what the problem was/is.

Additionally, monitoring station 26 and panels 22 may establish voice channels—in particular two-way voice channels allowing individuals audible at detector 36 in communication with panels 22 to communicate with monitoring centre 32. Ultimately, the voice channels may allow communication with operators at monitoring centre 32 through speakers 54 and/or microphones 52 at terminals 50 to allow the operators to converse with premises 28, in real time. Sound at premises 28 may be picked up by detector 36 and reproduced by transducer 34. Audio may be encoded/decoded by codecs 70 and 46.

Exemplary of embodiments of the present invention, voice channels are further used to provide audible pre-programmed message to premises 28, prior to facilitating the operator/premises two way communication.

Figure 4:
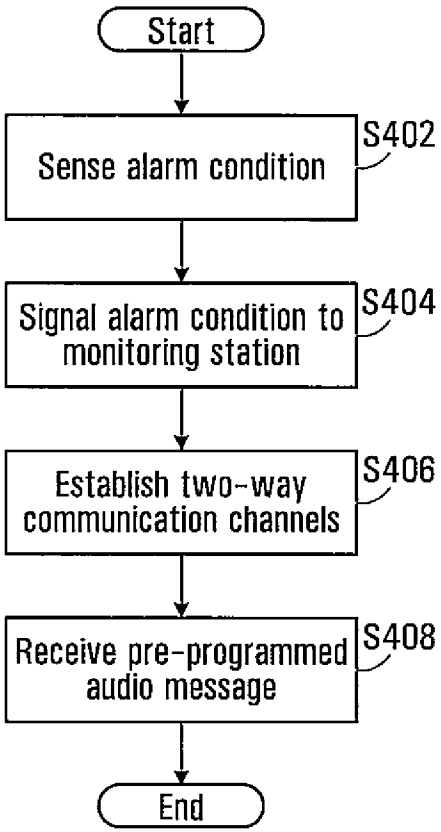
FIGS. 4 and 5 are flow diagrams depicting steps performed at the alarm panel and central monitoring station of FIG. 1, respectively, exemplary of embodiments of the present invention.
Figure 5:
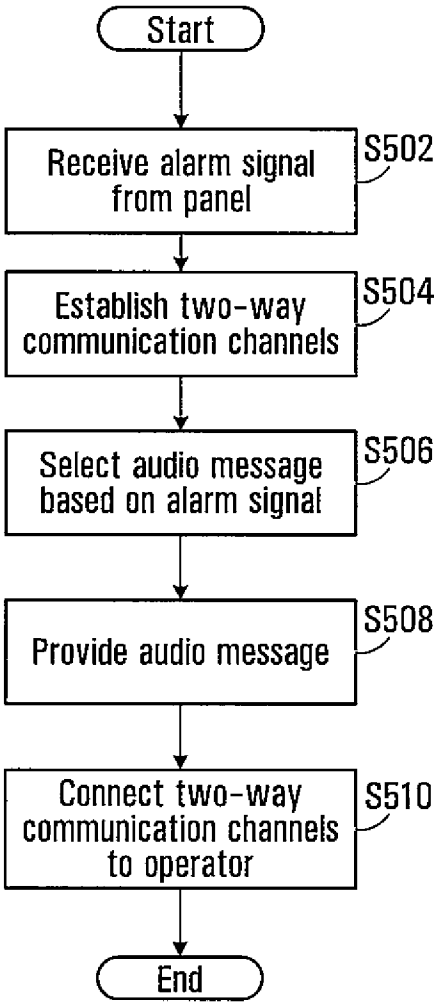

In particular, in operation, steps performed at monitoring server 32 are depicted in FIG. 5. Steps performed at panel 22 are illustrated in FIG. 4.

In the presence of an alarm condition at panel 22, as sensed in block S402, panel 22 generates an alarm message and dispatches it to the assigned monitoring server 32 for that panel 22 in block S404 using network 24, and the data network address of server 32 assigned to that panel. As noted, each alarm message includes at least an identifier of the panel 22 originating the message and the sensed condition giving rise to the alarm condition. Monitoring server 32, upon receipt of the message in block S502 may more particularly identify the panel 22 and associated premises 28 using, for example, database 44, and generate a message or communication (i.e. phone call, etc) for downstream handling, to eventually dispatch personnel to the monitored premises as required, or notify, for example, the owner, occupant or superintendent of the premises. The message may, for example, be dispatched to an operator at one of terminals 50, for further handling.

Additionally, panel 22 and monitoring server 32 establish two further communications paths (e.g. a two way communication channel capable of carrying voice traffic) with monitoring station 26, over network 24 in block S406 and S504. The communications paths may be established by either panel 22, or monitoring server 32. The two way channel may be voice-over-IP connections, for example using the H.323, MGCP, SIP or other suitable protocol(s). Once established the two way channel may be routed to an operator at monitoring server 32, for example at a terminal 50 in block S510.

However, prior to an operator using the voice channels to terminal 50, monitoring server 32 may use the information about the sensed alarm to select an audio message in block S506. In particular, monitoring server 32 uses the alarm condition/alarm source, as signalled by panel 22 in block S404 to identify a suitable audio message in voice message data block 48. The voice message is extracted by voice message generation module 40 and dispatched to panel 28 in block S508. To that end, voice message parser/synthesizer 40 may assemble the voice message from the data in voice message data memory 48.

Figure 6:
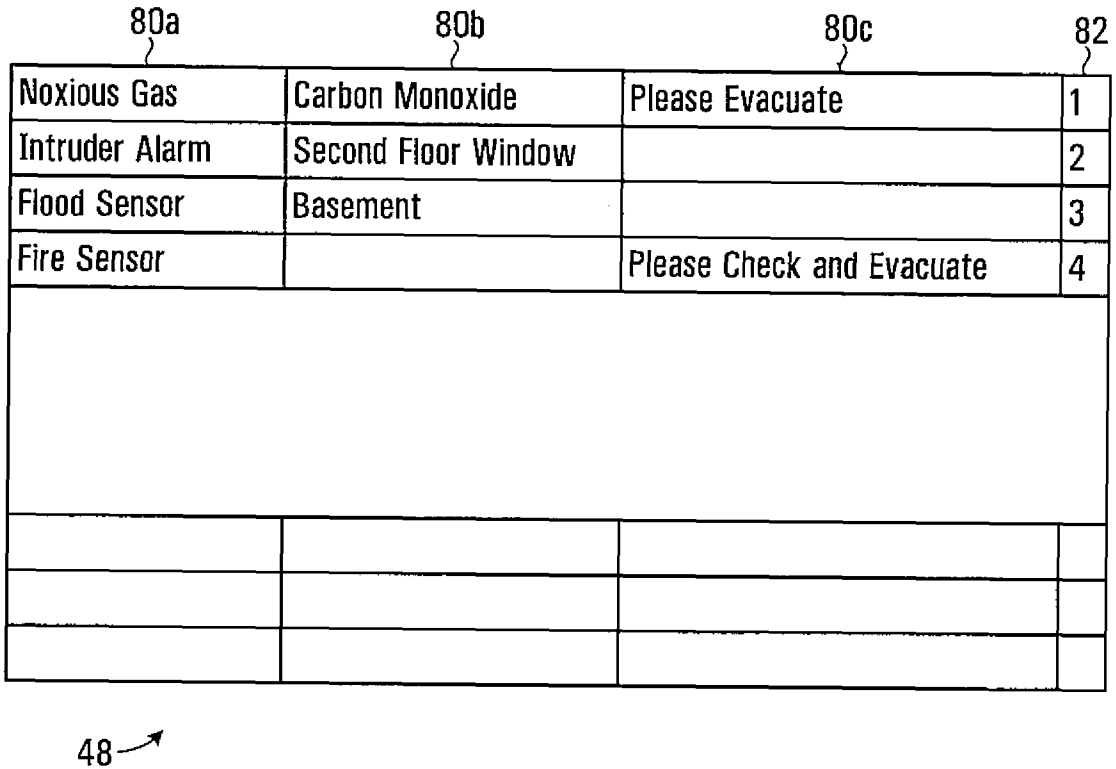
FIG. 6 is a block diagram schematically illustrating the partial contents of memory at the central monitoring station of FIG. 1.

In one example embodiment, as depicted in FIG. 6, voice data block includes voice data for individual voice message corresponding to voice messages to be presented to premises 28. In this depicted embodiment, voice data in the form of digital encoded (e.g. PCM, or the like) voice data fragments 80*a*, 80*b* and 80*c* (individually and collectively data fragments 80), each representing a particular message or portion thereof are stored within voice data memory. Each is associated with an index entry 82. Processor 60 may associate the alarm code provided in block S406 with a suitable index 82 in memory 48. In one embodiment, each value of index 82 is the same as the alarm code generated at panel 22. Alternatively, a mapping between an alarm code and one or more values of index 82 may be stored in memory 48. Processor 60 may provide the voice data fragment associated with the index 82 to voice message generation module 40. Voice generation module 40, in turn, generates voice data and provides it to codec 70, for further encoding, and provision to panel 22 over channel 80.

In the depicted embodiment, the voice message data fragment 80*a* may provide an indicator of the nature of the alarm condition—for example fire, noxious gas (e.g. carbon monoxide), flood, intrusion, etc. A further voice message data fragment 80*b* may further include particulars of the alarm type (e.g. intrusion—front door; gas—CO; etc.). And another data fragment 80*c* may indicate a proposed action (e.g. gas—

CO—evacuate the premises). In the depicted embodiment, each voice data fragment 80 may represent a portion voice message. Processor 60 (and/or voice generation module) may parse multiple data fragments to form the voice message. A mapping of an alarm code to multiple voice data fragments, identified by index 82 may additionally be stored, allowing the complete voice message to be parsed from multiple voice data fragments. In other embodiments, each voice data fragment may represent a complete message (e.g. alarm type; and particulars; and proposed action).

So, for example, an alarm message including an alarm code identifying the sensing of Carbon Monoxide, may cause processor 60 to parse data fragments 80*a*, 80*b*, and 80*c* identified by the index "1" in FIG. 6, allowing voice generation module 40 to reproduce the audio message "NOXIOUS GAS—CARBON MONOXIDE—PLEASE EVACUATE".

Voice message data fragments 80 may be injected directly into a suitable channel. For example, voice data fragments 80 could be stored in a compressed format compatible with the VoIP connection, and may be provided directly over the connection with further decoding by codec 70. Alternatively, voice message data fragments 80 could be decoded and re-encoded by codec 46 (or another suitable codec—not illustrated).

In yet a further embodiment, voice message generation module 40 may be capable of synthesizing voice. In this case, only multiple index entries corresponding to an alarm code may be stored in memory 48. Voice message generation module 40 may synthesize the voice message for coding by codec 46, and provision to panel 22. At panel 22, the provided voice message may be decoded by codec 70, and replayed at transducer 34.

After the voice message has been provided in block S508, the voice connections may be routed to an operator at monitoring server 32, for example at a terminal 50 in block S510.

Once an operator becomes available s/he may Listen to audio at premises 28 and speak to premises 28. Audio at premises 28 may be picked up by detector 36 (acting as a microphone), converted to data by codec 70 and provided to monitoring station 32 over network 30, where it may be stored and decoded by codec 46 for playback at a speaker 54.

Audio spoken into microphone 52 may be encoded by codec 46 at monitoring server 32. Corresponding data may be provided to panel 22 over the established two way communication channel. At panel 22, the audio data from server 32 may be decoded using codec 70. Decoded audio may be provided to transducer (speaker) 34 allowing real-time, two-way, audio communication between monitoring station 26 and panel 22.

Optionally, pre-programmed voice messages may also be available to a panel installer at premises 28. Thus, for example, a panel installer may place alarm panel 22 in a configuration mode. In response to tripping certain sensors 30, and otherwise interacting with panel 22, panel 22 generates alarm signals that may be identified as configuration/install alarm signals at monitoring station 26. Corresponding voice messages may be stored in voice message memory 48, allowing the installer to verify proper installation of panel 22 and detectors 30.

Of course, the above described embodiments are intended to be illustrative only and in no way limiting. The described embodiments of carrying out the invention are susceptible to many modifications of form, arrangement of parts, details and order of operation. The invention, rather, is intended to encompass all such modification within its scope, as defined by the claims.

What is claimed is:

1. A method of operating an alarm monitoring station, said method comprising:

a. receiving an alarm message signalling an alarm condition at a premises from an alarm panel;

b. establishing a two way communications channel over a network to connect said monitoring station and said alarm panel, for real time voice communication between said panel and monitoring station;

c. selecting at said monitoring station a pre-programmed voice message based on said sensed alarm condition at said premises as indicated in said alarm message; and d. providing said pre-programmed voice message from said monitoring station to said panel over said two way communications channel.

2. The method of claim 1, further comprising synthesizing said pre-programmed voice message.

3. The method of claim 1, further comprising assembling said pre-programmed voice message from several voice message fragments.

4. The method of claim 3, wherein said voice message fragments include a voice message fragment indicative of at least one of alarm type, alarm location, and instructions.

5. The method of claim 1, wherein said alarm message comprises a configuration message initiated by an installer, and wherein said pre-programmed voice message comprises an installer status message.

6. The method of claim 1, wherein said alarm message indicates an alarm condition at the premises, and wherein said voice message provides details about said alarm condition to said premises.

7. The method of claim 1, wherein said two way communications channel is a voice over internet protocol (VoIP) call.

8. The method of claim 1, further comprising connecting said two way communications channel to an operator at said monitoring station after providing said pre-programmed voice message to said panel.

9. An alarm monitoring station comprising at least one processor operable to a. receive an alarm message signalling an alarm condition at a premises from an alarm panel;

b. establish a two-way communications channel over a network to connect said monitoring station and said alarm panel, for real time voice communication between said panel and said monitoring station;

c. select a pre-programmed voice message at said alarm monitoring station, based on said sensed alarm condition at said premises as signalled to said alarm monitoring station by said alarm message; and d. provide said pre-programmed voice message from said monitoring station to said panel over said two way communications channel.

10. The alarm monitoring station of claim 9, comprising a voice synthesizer to synthesize said pre-programmed voice message.

11. The alarm monitoring station of claim 9, further operable to assemble said pre-programmed voice message from several voice message fragments.

12. The alarm monitoring station of claim 10, wherein said voice message fragments include a voice message fragment indicative of at least one of alarm type, alarm location, and instructions.

13. The alarm monitoring station of claim 9, wherein said alarm message comprises a configuration message initiated by an installer, and wherein said pre-programmed voice message comprises an installer status message.

14. The alarm monitoring station of claim 9, wherein said alarm message indicates an alarm condition at the premises, and wherein said voice message provides details about said alarm condition to said premises.

15. The alarm monitoring station of claim 9, further comprising a voice over internet protocol (VoIP) call capable network interface.

16. The alarm monitoring station of claim 9, further comprising an operator interface to connect said two way communications channel to an operator at said monitoring station, and wherein said monitoring station is further operable to connect said two way communications channel to said operator after providing said pre-programmed voice message to said panel.

17. The alarm monitoring station of claim 9, further comprising connecting said two way communications channel to an operator at said monitoring station

18. A method of operating an alarm panel at a premises, said method comprising:

a. providing an alarm message signalling an alarm condition at the premises to a monitoring station;

b. establishing a two way communications channel over a network to connect said monitoring station and said alarm panel, for real time voice communication between said panel and monitoring station; and c. receiving a pre-programmed voice message over said two way communications channel, said pre-programmed voice message selected at said alarm monitoring station based on said sensed alarm condition at the premises as signalled to said monitoring station in said alarm message by said panel.

* * * * *